US011358195B2

(12) United States Patent
Opitz et al.

(10) Patent No.: US 11,358,195 B2
(45) Date of Patent: Jun. 14, 2022

(54) COOLING OF ROLLED MATERTIAL

(71) Applicant: Primetals Technologies Austria GmbH, Linz (AT)

(72) Inventors: Erich Opitz, Mönchhof (AT); Lukas Pichler, Linz (AT); Alois Seilinger, Linz (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 153 days.

(21) Appl. No.: 16/607,399

(22) PCT Filed: Mar. 14, 2018

(86) PCT No.: PCT/EP2018/056437
§ 371 (c)(1),
(2) Date: Oct. 23, 2019

(87) PCT Pub. No.: WO2018/197100
PCT Pub. Date: Nov. 1, 2018

(65) Prior Publication Data

US 2020/0047230 A1 Feb. 13, 2020

(30) Foreign Application Priority Data

Apr. 26, 2017 (EP) ..... 17168241

(51) Int. Cl.
*B21B 45/02* (2006.01)
*B21B 37/44* (2006.01)
(Continued)

(52) U.S. Cl.
CPC ..... *B21B 45/0218* (2013.01); *B21B 45/0233* (2013.01); *B21B 37/44* (2013.01);
(Continued)

(58) Field of Classification Search
CPC ..... B21B 45/0215; B21B 45/0218; B21B 45/0233; C21D 1/667
(Continued)

(56) References Cited

U.S. PATENT DOCUMENTS 4,440,584 A 4/1984 Takeshige et al. ..... 148/128
4,511,089 A * 4/1985 Ebata ..... B05B 1/202 137/561 A
(Continued)

FOREIGN PATENT DOCUMENTS

CN 101678419 A 3/2010
DE 4009868 A1 * 10/1991 ..... B21B 45/0233
(Continued)

OTHER PUBLICATIONS

Juergen, Translation of DE-4009868-A1 (Year: 1991).*
(Continued)

*Primary Examiner* — Gregory D Swiatocha
*Assistant Examiner* — Bobby Yeonjin Kim
(74) *Attorney, Agent, or Firm* — Ostrolenk Faber LLP

(57) ABSTRACT

A cooling bar (1) for cooling rolled material (5) being moved in a transport direction (3) and in particular for reducing temperature differences in the temperature of the rolled material (5) transversely to the direction of transport (3). The cooling bar (1) has several full jet nozzles (11) by means of which a coolant beam of a coolant with an approximately constant jet diameter can be distributed to the rolling stock (5) in the direction of distribution (15). A cooling device has at least two cooling bars (1) of that type. The cooling bars extend transversely to a transport direction, one behind the other. Each cooling bar has a respective different pattern of jet nozzles and selection of applicable pattern of jet nozzles in their respective bars selectively cools the rolled material transversely to the transport direction.

5 Claims, 9 Drawing Sheets

(51) Int. Cl.
*B21B 37/74* (2006.01)
*B21B 27/10* (2006.01)
*B22D 11/124* (2006.01)

(52) U.S. Cl.
CPC ..... *B21B 37/74* (2013.01); *B21B 2027/103* (2013.01); *B22D 11/1246* (2013.01)

(58) Field of Classification Search
USPC ..... 266/113
See application file for complete search history.

(56) References Cited

U.S. PATENT DOCUMENTS

| | | | | |
|---|---|---|---|---|
| 4,591,133 | A | 5/1986 | Umeno et al. | 266/114 |
| 6,062,056 | A * | 5/2000 | Groch | B21B 45/0218 72/201 |
| 6,185,970 | B1 | 2/2001 | Latzel | 72/201 |
| 7,181,822 | B2 | 2/2007 | Ondrovic et al. | 29/527.7 |
| 7,779,661 | B2 | 8/2010 | Fujibayashi et al. | 72/201 |
| 9,180,504 | B2 * | 11/2015 | Baumgartel | B21B 37/44 |
| 9,358,597 | B2 * | 6/2016 | Beeston | B21B 45/0233 |
| 9,868,142 | B2 | 1/2018 | Chen et al. | |
| 2006/0027163 | A1 * | 2/2006 | Ebner | B21B 45/0218 118/300 |
| 2009/0211670 | A1 * | 8/2009 | Fujibayashi | B21B 45/0233 148/661 |
| 2012/0235331 | A1 * | 9/2012 | Lemay | F27B 9/12 266/44 |

FOREIGN PATENT DOCUMENTS

| | | | |
|---|---|---|---|
| DE | 198 54 675 | A1 | 6/2000 |
| DE | 199 34 557 | A1 | 2/2001 |
| DE | 10 2007 053 523 | A1 | 12/2008 |
| EP | 0 081 132 | A1 | 6/1983 |
| EP | 0 449 003 | A2 | 10/1991 |
| EP | 0 997 203 | A1 | 5/2000 |
| EP | 1 527 829 | A1 | 5/2005 |
| EP | 1 938 911 | A1 | 7/2008 |
| JP | S59-009072 | U | 1/1984 |
| JP | S59-137111 | A | 8/1984 |
| JP | S62-1789 | A | 1/1987 |
| JP | S62-93010 | A | 4/1987 |
| JP | S63-111209 | U | 7/1988 |
| JP | H01-178309 | A | 7/1989 |
| JP | H05-39709 | U | 5/1993 |
| JP | H06-212279 | A | 8/1994 |
| JP | 2001-321821 | A | 11/2001 |
| JP | 2008-264597 | A | 11/2008 |
| JP | 2011-194417 | A | 10/2011 |
| SK | SU 908848 | A1 | 2/1982 |
| WO | WO 03/070991 | A1 | 8/2003 |
| WO | WO 2006/076771 | A1 | 7/2006 |
| WO | WO 2014/170139 | A1 | 10/2014 |

OTHER PUBLICATIONS

Japanese Office Action, dated Jan. 12, 2021, issued in corresponding Japanese Patent Application No. 2019-555876. English translation. Total 9 pages.
European Brief Communication, dated Mar. 8, 2021, issued in corresponding European Patent Application No. 17168241.2. Total 11 pages.
International Search Report dated Oct. 19, 2018 in corresponding PCT International Application No. PCT/EP2018/056437.
Written Opinion dated Oct. 19, 2018 in corresponding PCT International Application No. PCT/EP2018/056437.
Partial European Search Report dated Oct. 9, 2017 in corresponding European Patent Application No. EP 17168241.2.
Extended European Search Report dated Jan. 25, 2018 in corresponding European Patent Application No. EP 17168241.2.
Chinese Office Action, dated Jul. 2, 2020, issued in corresponding Chinese Patent Application No. 201880027555.1. Total 25 pages.
Japanese Notice of Allowance, dated Aug. 16, 2021, issued in corresponding Japanese Patent Application No. 2019-555876. English translation. Total 5 pages.

* cited by examiner

COOLING OF ROLLED MATERTIAL

CROSS-REFERENCE TO RELATED APPLICATIONS

The present application is a 35 U.S.C. §§ 371 national phase conversion of PCT/EP2018/056437, filed Mar. 14, 2018, the contents of which are incorporated herein by reference which claims priority of European Patent Application No. 17168241.2, filed Apr. 26, 2017, the contents of which are incorporated by reference herein. The PCT International Application was published in the German language.

TECHNICAL FIELD

The invention relates to a cooling bar for cooling rolled material which is moved in a transport direction. In addition, the invention relates to a cooling device with such multiple such cooling bars and to a method for operating such a cooling device.

TECHNICAL BACKGROUND

During hot rolling of rolled material, for example of a slab, the rolled material is reshaped by rolling it at high temperatures. In order to cool the rolled material, a coolant, usually water, is applied to the rolled material. The temperature of the rolled material often varies transversely to its transport direction. Such temperature differences may impair the quality of the rolled material. Different cooling devices and methods are known in order to reduce the temperature differences.

WO 2014/170139 A1 discloses a cooling device for flat rolled material with multiple spray bars which extend transversely to a transport direction of the rolled material. When viewed transversely to the transport direction, each spray bar comprises two outer regions and one central region which is arranged between the two outer regions. A liquid cooling medium is feedable into the regions, into each region by its own, individually controllable valve device.

DE 10 2007 053 523 A1 discloses a device for influencing the temperature distribution over the width of a slab or of a strip. At least one cooling device with nozzles is provided for applying a coolant onto the slab or onto the strip. The nozzles are arranged and/or actuated distributed over the width in such a manner that a coolant is applied, in particular, to positions at which an increased temperature is determinable.

WO 2006/076771 A1 discloses a hot rolling mill and a method for operating it, with the form of a rolled strip being controlled by localized cooling devices. The cooling devices are arranged at intervals along working rollers in at least three lateral zones.

DE 199 34 557 A1 discloses a device for cooling metal strips or metal sheets conveyed along a conveyor section, in particular hot-rolled steel strips at the outlet of a rolling line, with at least one cooling bar which extends substantially over the width of the conveyor section for applying coolant to the metal strip or sheet to be cooled.

EP 0 081 132 A1 discloses a cooling device for uniform cooling of a thick steel plate. A desired amount of water is output in the direction of the width of the steel plate by multiple bar-like distributors.

DE 198 54 675 A1 discloses a device for cooling a metal strip, in particular a hot-rolled strip, at the outlet of a rolling line with at least two nozzles distributed over the width of the metal strip. A control and regulating device controls a respective coolant flow, which emerges from each nozzle, individually depending on a registered temperature of a portion of the width of the metal strip assigned to the respective nozzle.

SUMMARY OF THE INVENTION

The object of the invention is to provide a device for cooling rolled material which is moved in a transport direction and a method for operating the device, wherein the method and the device are improved, in particular, with regard to leveling out temperature differences in the rolled material transversely to the transport direction.

The object is achieved by a cooling bar with the features disclosed herein, a cooling device with the features disclosed herein and a method with the features disclosed herein.

A cooling bar according to an embodiment of the invention for cooling rolled material is moved in a transport direction. The cooling bar includes a spray chamber which is filled with a coolant and multiple full jet nozzles which are supplied with coolant from the spray chamber. A coolant jet of a coolant with an almost constant jet diameter may be output through each jet nozzle to the rolled material in an output direction. Each full jet nozzle comprises a tubular nozzle body having an open end arranged in an upper region of the cooling bar inside the spray chamber for supplying coolant into the full jet nozzle. A distribution chamber for intermediate storage of the coolant is connected to the spray chamber by at least one through opening for enabling filling the spray chamber with coolant from the distribution chamber. Each through opening is preferably arranged on an upper side of the distribution chamber, between the distribution chamber and the spray chamber. The open end of the tubular nozzle body of a full jet nozzle is arranged above the height of the upper side of the distribution chamber.

This cooling bar makes it possible to output coolant from the spray chamber to the rolled material by means of full jet nozzles. A full jet nozzle is to be understood as a nozzle through which a substantially straight coolant jet is able to be output. The advantage of using full jet nozzles is that the distance between the cooling bar and the rolled material is not critical within a wide range, typically up to approximately 1500 mm on account of the substantially straight coolant jets. Consequently, that distance may be varied within said range without, in this case, negatively influencing the cooling action, as the cooling action occurs substantially only at the direct impact zones of the coolant jets.

A further advantage of full jet nozzles, compared to normally used cone or flat jet spray nozzles, results from full jet nozzles generating a higher impact pressure of the coolant on the rolled material than cone or flat jet spray nozzles. This is a result of the bundled delivery of the coolant at the same coolant pressure in the cooling bar. The higher impact pressure acts positively on the cooling action on the surface of the rolled material because, on account of the overall large amount of coolant applied, there is always a certain coolant film there with a thickness of typically between multiple millimeters and centimeters. This film has to be penetrated by the impinging coolant jets as completely as possible in order to achieve a high relative speed of the coolant with respect to the surface of the rolled material and consequently good heat dissipation. In addition, even if the nozzle arrangement includes very narrow spacing, the coolant jets of full jet nozzles do not interact as may occur with cone or flat jet spray nozzles.

In contrast to cone or flat jet spray nozzles which cause jet widening and consequently require higher operating pressure, full jet nozzles provide the possibility, on account of their high impact pressure, of operating a cooling bar according to the invention at a relatively low coolant pressure. This has an advantageous effect on energy consumption and on the selection of more cost-efficient peripheral devices, such as pumps. For example, a cooling bar according to the invention is supplied in high-pressure operation with a coolant pressure of up to 10 bar. With this, a pressure below the coolant pressure by less than 1 bar is still achieved at an individual full jet nozzle. As an alternative, however, a cooling bar according to the invention may also be used in a laminar operation (low-pressure operation) at a coolant pressure of, for example, approximately only 1 bar.

In addition, compared to cone or flat jet spray nozzles, full jet nozzles are considerably less sensitive to mechanical influences on account of their compact and sturdy design. This is an advantage, for example, in the case of a tear in the rolled material where the strip end is driven.

The division of the cooling bar into a spray chamber and a distribution chamber and the realization of the cooling bar with full jet nozzles is particularly advantageous when the cooling bar is arranged above the rolled material and the coolant is output downward onto the rolled material, i.e. when the output direction matches the direction of the force of gravity at least approximately. In that case, the realization according to the invention makes it possible, in an advantageous manner, in case of an interruption in the cooling of the rolled material after interruption in the coolant supply to the cooling bar, for a relatively small amount of coolant to continue to run out of the cooling bar and be output onto the rolled material, while a large amount of coolant remains in the cooling bar. As a result, when cooling resumes, the cooling bar may also be more quickly filled with coolant quicker due to the smaller volume to be filled than if the cooling bar were emptied entirely in the event of an interruption in the cooling. This is achieved by the intermediate storage of coolant in the distribution chamber. As a result of the intermediate storage, with the at least one through opening arranged suitably between the spray chamber and the distribution chamber, and in particular arranged at an upper side of the distribution chamber, the distribution chamber remains completely or in part filled with coolant when there is an interruption in the coolant supply. In addition, this is achieved by the nozzle bodies of the full jet nozzles extending inside the spray chamber up to an upper region of the cooling bar so that if there is an interruption in the coolant supply, coolant may only run out of the region of the spray chamber located above the open ends of the nozzle bodies and out of the nozzle bodies themselves, while the remaining volume of the spray chamber remains filled with coolant.

The realization of a cooling bar with a distribution chamber additionally makes it possible, in an advantageous manner, to reduce pressure gradients and flow turbulence in the spray chamber as a result of arranging the at least one through opening to the spray chamber in a suitable manner, in particular by arranging that opening on an upper side of the distribution chamber, so that all full jet nozzles of a cooling bar are acted upon substantially at the same pressure and a substantially laminar flow is achieved in the spray chamber.

A cooling bar hereof provides a nozzle density or/and an outlet diameter of the full jet nozzles that varies transversely to the transport direction. The nozzle density here is a number of nozzles per surface area. By varying the nozzle density or/and the outlet diameter of the full jet nozzles transversely to the transport direction, a corresponding variation in the cooling action of the cooling bar transversely to the transport direction is achieved. Temperature differences in the rolled material transversely to the transport direction may be advantageously reduced.

A further design feature of a cooling bar according to the invention provides that the full jet nozzles are arranged in at least one nozzle row which extends transversely to the transport direction. A further development of that design of a cooling bar provides that the full jet nozzles are arranged in multiple nozzle rows which extend transversely to the transport direction. Further, the full jet nozzles of various nozzle rows are arranged offset to one another in the transport direction. This includes an arrangement of the full jet nozzles of different nozzle rows where those full jet nozzles of different nozzle rows are not arranged one behind another along the transport direction and consequently those nozzle arrangements do not form any nozzle rows which extend in the transport direction. As a result, the nozzle rows achieve a particularly uniform cooling action by avoiding "cooling grooves" which extend in the transport direction and in which no coolant is output onto the rolled material.

In addition, a distance between nozzles of the full jet nozzles which are adjacent one another in each nozzle row may vary. As a result, in an advantageous manner, temperature differences in the temperature of the rolled material which vary transversely to the transport direction may be reduced particularly well. For example, the distance between nozzles in a row may be smallest in a central region of the output side of the cooling bar and may increase in each case toward the edge regions. Such a distribution of the full jet nozzles may be used advantageously for cooling rolled material, wherein the temperature of the rolled material is highest in a central region and reduces toward the edge regions.

A further design of a cooling bar according to the invention provides at least one coolant deflecting device for conducting coolant which is output by full jet nozzles arranged in an edge region of the spray chamber. This so-called edge masking may advantageously prevent too much coolant passing onto an edge region of the rolled material and may prevent the edge region being cooled too severely as a result.

A cooling device according to the invention for cooling rolled material which is moved in a transport direction includes multiple cooling bars which are arranged one behind another along the transport direction. Each comprises multiple full jet nozzles, and a coolant jet of a coolant with an almost constant jet diameter may be output through each of the jet nozzles to the rolled material. In this case, at least two of the cooling bars comprise nozzle densities and/or outlet diameters of their full jet nozzles which vary differently from one another transversely to the transport direction.

In addition, the cooling device includes a temperature measuring device for determining a temperature distribution of a temperature of the rolled material transversely to the transport direction. This makes it advantageously possible for the cooling bars to be controlled in dependence on the determined temperature distribution and consequently for the rolled material to be cooled taking the respective temperature distribution into consideration.

Furthermore, the cooling device according to the invention provides a control device for automatically controlling flow volumes of coolant to the individual cooling bars in dependence on a temperature distribution of the temperature of the rolled material transversely to the transport direction. In this case, the temperature distribution may be recorded by a temperature measuring device, or the temperature distribution may be determined from a model of the rolled material and/or empirical data. The control device comprises, for example, control valves, by means of which the flow volumes of coolant to the individual coolant strips are controllable independently of one another. As a result, the cooling effects of the individual cooling bars may advantageously be controlled independently of one another so that the cooling effect of the entire cooling device may be adapted flexibly to the temperature distribution of the temperatures of the rolled material transversely to the transport direction.

Such a cooling device makes it possible to reduce temperature differences in the temperature of the rolled material transversely to the transport direction by a specifically targeted use of the cooling bars arranged one behind another. As the cooling device comprises cooling bars with nozzle densities and/or outlet diameters which vary differently from one another transversely to the transport direction, different cooling effects may be achieved, which may be adapted to the temperature distribution of the temperature of the rolled material, in order to reduce temperature differences transversely to the transport direction. This is a result of the interactions between the cooling bars and, where necessary, as a result of activation and deactivation of individual cooling bars. In contrast to the above-named cooling devices disclosed in the prior art, the full jet nozzles of the cooling bars herein are not actuated individually. Instead, only in each case are the individual cooling bars activated, which clearly reduces the structural expenditure and the susceptibility to failure compared to the actuation of the individual nozzles in the prior art.

At least two cooling bars with different jet nozzle patterns are needed to change the (overall) spray pattern applied to the rolled material. To be specific, since every single spray bar according to the invention has only one spray chamber, the spray pattern of each spray bar is unchangeable by its respective construction and depends only on the individual arrangement of nozzles and/or nozzle diameters as depicted in FIGS. 3-8, for instance. At least two of the spraying bars will have a different respective arrangement of nozzles and/or nozzle diameters for providing individual possibly differing spray patterns, at different transverse direction locations. But on the other hand, the overall spray pattern applied by the combination of all cooling bars of the cooling device onto the rolled material can be changed by the control device by adapting/adjusting the flow volumes of the individual cooling bars. In other words, the spray pattern of an individual cooling bar is fixed in a direction transverse to the transport direction and can take a form such as $V_1$-$V_5$ as depicted in FIG. 9, for example. Only the amplitude (corresponding to the volume flow of coolant) of the spray pattern of a single cooling bar can be regulated, for instance via the associated valve 51 in FIG. 12).

Hence, the overall spray pattern applied to the rolled material results from a combination of at least two individual spray patterns of respective cooling bars. As a result, the overall spray pattern can be varied by adjusting the amplitudes of the individual spray patterns by regulating the volume flows through the cooling bars.

A design of the cooling device according to the invention provides that the nozzle densities of two of the cooling bars comprise maximum nozzle densities, which are arranged transversely to the transport direction on sides of the cooling bars which differ from one another, and/or that the outlet diameters of the full jet nozzles of two of the cooling bars comprise maximum outlet diameters which are arranged transversely to the transport direction on sides of the cooling bars which differ from one another. Through these designs, temperature differences between different sides of the rolled material, for example between oppositely situated edge regions of the rolled material, may be leveled out by the respectively hotter side of the rolled material being cooled more strongly than the other side.

As an alternative or in addition, the cooling device may comprise at least one cooling bar where the nozzle density and/or the outlet diameter of the full jet nozzles is maximum in a central region of the cooling bar and decreases toward the edge regions of the cooling bar transversely to the transport direction, and/or at least one cooling bar where the nozzle density and/or the outlet diameter of the full jet nozzles is minimum in a central region of the cooling bar and increases toward the edge regions of the cooling bar transversely to the transport direction. As a result, temperature differences between a central region and the edge regions of the rolled material may be advantageously leveled out.

A further design of the cooling device provides at least one cooling bar arranged above the rolled material and at least one cooling bar arranged below the rolled material. As a result, the rolled material may advantageously be cooled both on the upper side and on the bottom side at the same time. As a result, a more effective and more uniform cooling of the rolled material is made possible.

In a further design of the cooling device according to the invention, at least one cooling bar, particularly at least one cooling bar arranged above the rolled material, is realized according to the above-named embodiment of a cooling bar. The advantages of this design of the cooling device are produced from the above-named advantages of the embodiment of a cooling bar.

In a method according to the invention for operating a cooling device according to the invention, a temperature distribution of a temperature of the rolled material is determined transversely to the transport direction; and flow volumes of coolant to the individual cooling bars are controlled in dependence on the determined temperature distribution.

The above-described characteristics, features and advantages of the invention and the manner in which they are achieved, will become clearer and considerably more comprehensible in conjunction with the following description of exemplary embodiments which will be explained in more detail in conjunction with the drawings, in which:

DESCRIPTION OF EMBODIMENTS

Correlating parts are provided with the same reference symbols in all figures.

Figure 1:
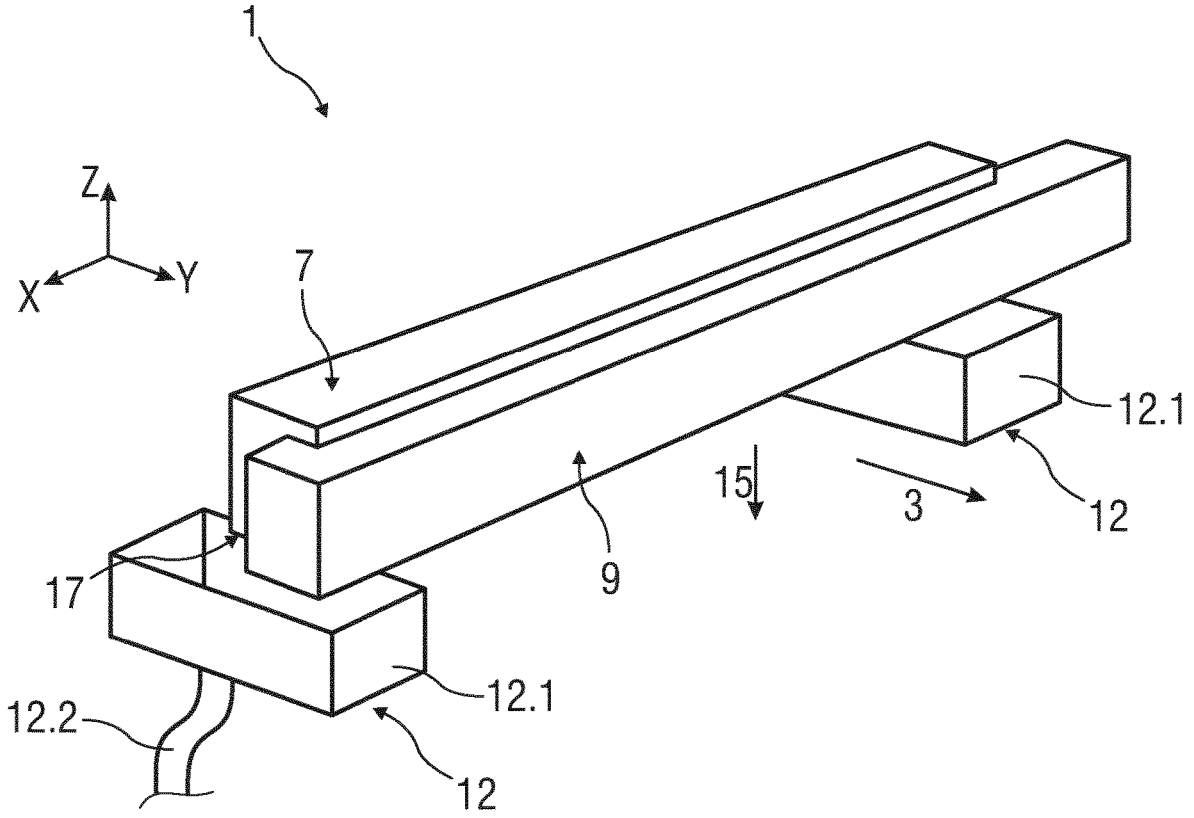
FIG. 1 shows a perspective representation of a first exemplary embodiment of a cooling bar according to the invention.
Figure 2:
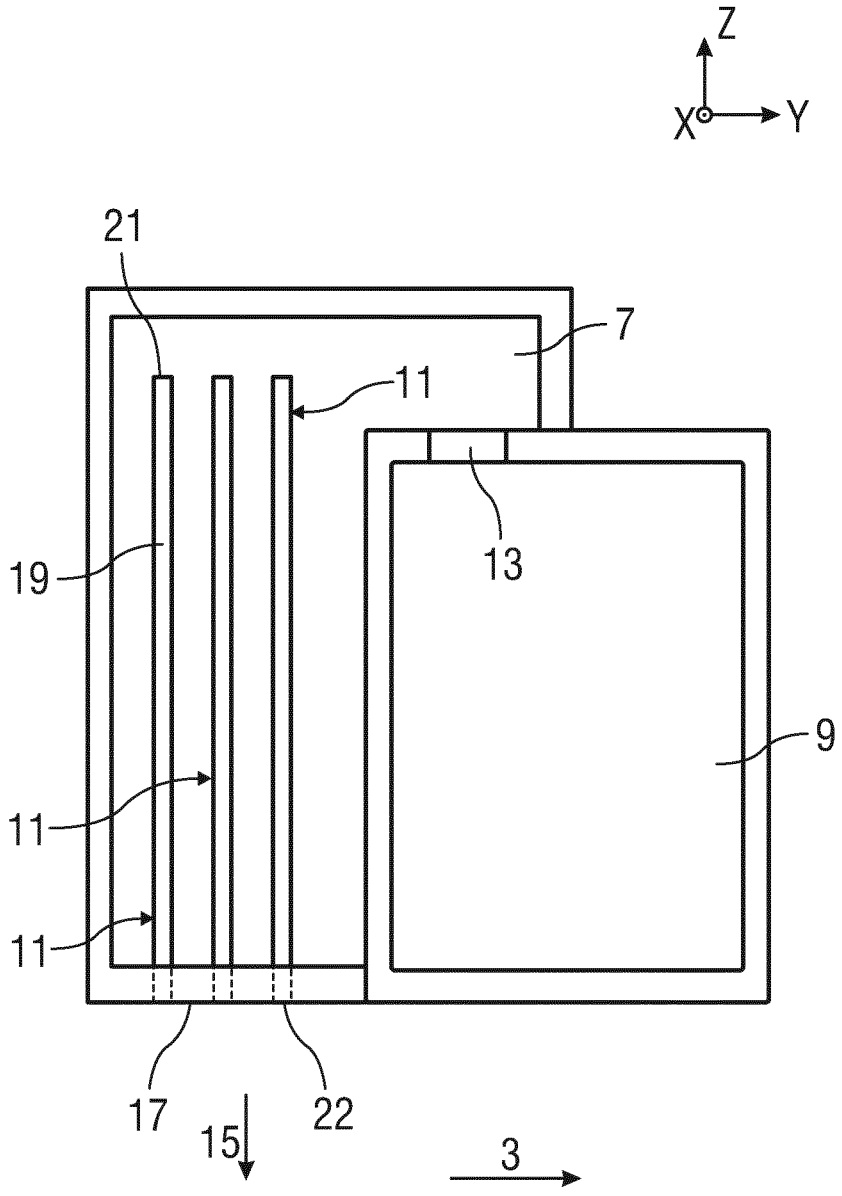
FIG. 2 shows a sectional representation of the cooling bar shown in FIG. 1.
Figure 3:
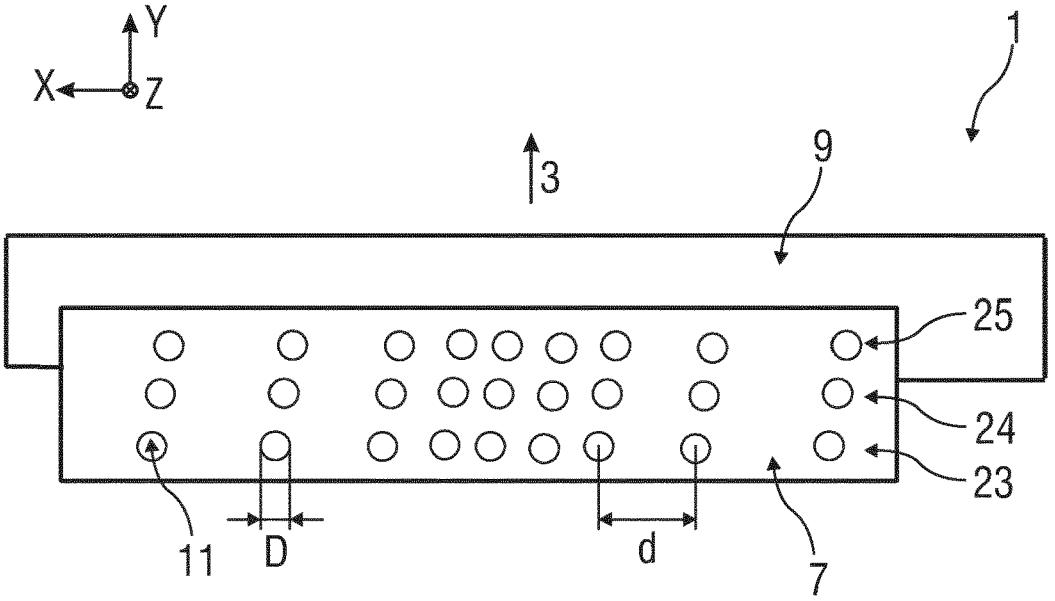
FIG. 3 shows a bottom view of the cooling bar shown in FIG. 1.
Figure 12:
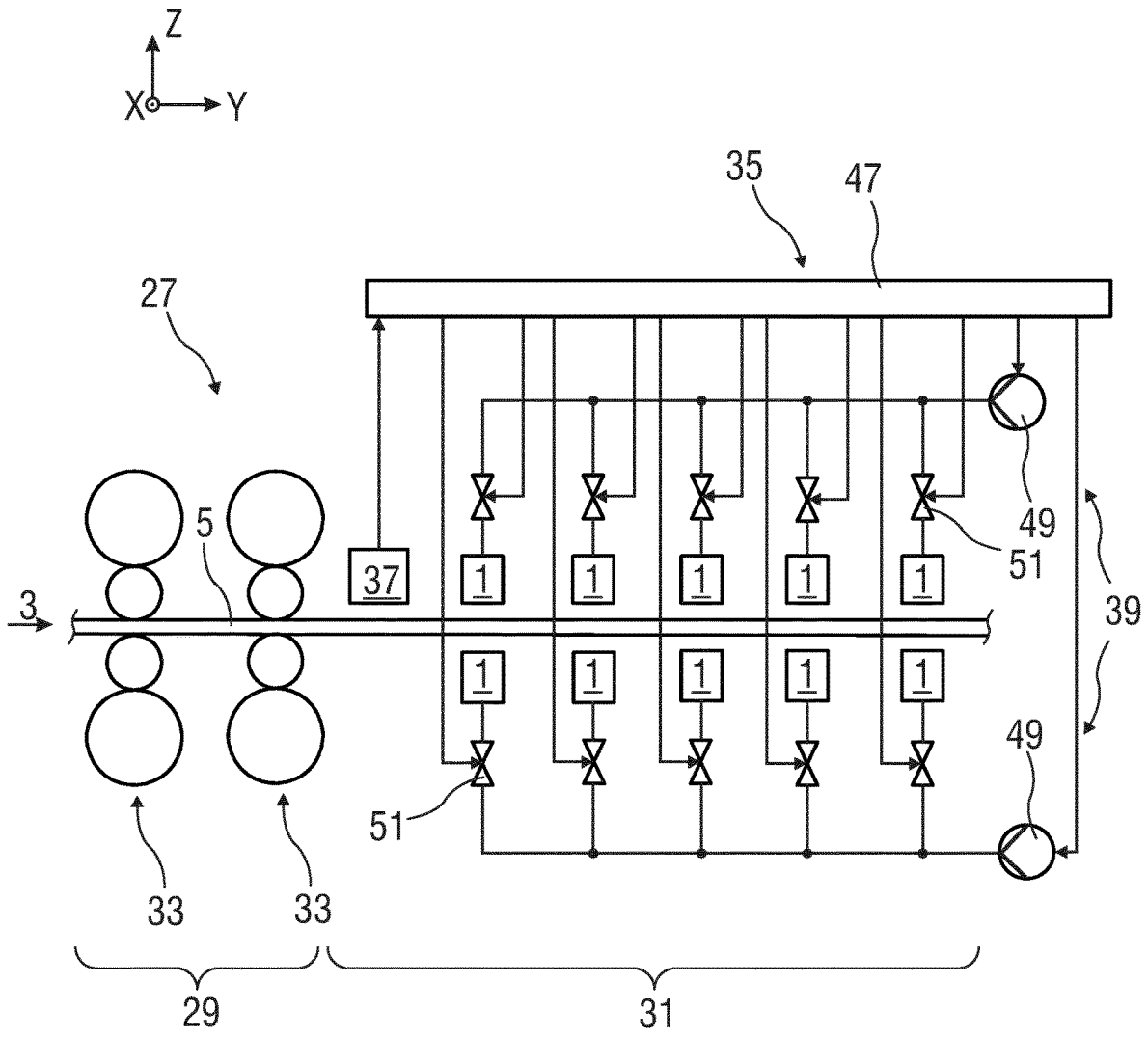

FIGS. 1-3 show schematic representations of a first exemplary embodiment of a cooling bar 1 for cooling rolled material 5, which material is moved in a transport direction 3 (see FIG. 12).

FIG. 1 shows a perspective representation of the cooling bar 1, FIG. 2 shows a sectional representation of the cooling bar 1 and FIG. 3 shows a bottom view of the cooling bar 1. In the figures, the transport direction 3 defines a Y direction of a Cartesian coordinate system with coordinates X, Y, Z, the Z axis of which extends vertically upward, i.e. runs in the opposite direction to the direction of the force of gravity. The cooling bar 1 extends transversely to the transport direction 3 in the X direction over the width of the rolled material 5.

The cooling bar 1 includes a spray chamber 7, a distribution chamber 9, multiple full jet nozzles 11 and two optional coolant deflecting devices 12. The spray chamber 7 and the distribution chamber 9 are each realized as a cavity with a longitudinal axis which extends in the X direction transversely to the transport direction 3. In this case, the distribution chamber 9 has a substantially rectangular cross section in a plane perpendicular to its longitudinal axis. In a plane perpendicular to its longitudinal axis, the spray chamber 7 comprises a cross section which has the form substantially of the Greek capital letter Gamma, the horizontally extending portion of the Gamma extending above the distribution chamber 9.

The spray chamber 7 and the distribution chamber 9 are connected together by multiple through openings 13. The through openings 13 are arranged on an upper side of the distribution chamber 9 one behind another in the X direction transversely to the transport direction 3. The distribution chamber 9 is fillable from the outside with a coolant, for example with cooling water, via a coolant inlet which is not shown. The spray chamber 7 is fillable with the coolant from the distribution chamber 9 via the through openings 13.

By means of each full jet nozzle 11, a coolant jet of coolant with an almost constant jet diameter may be output from the spray chamber 7 to the rolled material 5 in an output direction 15 from one output side 17 of the cooling bar 1. The output direction 15, in this case, is the direction of the force of gravity, i.e. the opposite direction to the Z direction. The output side 17, in this case, is the bottom side of the cooling bar 1. Each full jet nozzle 11 comprises a tubular nozzle body 19 with a vertically extending longitudinal axis, i.e. parallel to the Z axis. The nozzle body 19 extends inside the spray chamber 7 from a bottom of the spray chamber 7 to an open end 21 of the nozzle body 19, which is arranged in an upper region of the spray chamber 7 above the height of the upper side of the distribution chamber 9 and through which coolant from the spray chamber 7 may be fed into the full jet nozzle 11. The nozzle bodies 19 are realized, for example, in a hollow cylindrical manner or they taper in each case conically from their open end 21 toward the bottom of the spray chamber 7. The full jet nozzles 11 each comprise an outlet opening 22, the outlet diameter D of which, for example, is between 3 mm and 20 mm, preferably up to 12 mm.

The advantageous effect of the realization of the cooling bar 1 is that in the event of an interruption in the cooling of the rolled material 5, after interruption in the coolant supply to the distribution chamber 9, coolant may still only run only out of the region of the spray chamber 7 located above the open ends 21 of the nozzle bodies and out of the nozzle bodies 19 themselves to the rolled material 5 while the remaining volume of the spray chamber 7 and the distribution chamber 9 remain filled with coolant.

The cooling bar 1 additionally comprises a nozzle density of the full jet nozzles 11 which varies transversely to the transport direction 3. The nozzle density in this embodiment is at its maximum in a central region of the cooling bar 1 and decreases transversely to the transport direction 3 toward the edge regions of the cooling bar 1 (see FIG. 3). In this case, the full jet nozzles 11 are arranged in three nozzle rows 23-25 which extend transversely to the transport direction 3. The full jet nozzles 11 of different nozzle rows 23-25 are arranged offset to one another in the transport direction 3. The variation in the nozzle density transversely to the transport direction 3 is achieved by providing a distance d between nozzles of full jet nozzles 11 adjacent one another of each nozzle row 23-25. The distance d between nozzles is at a minimum in the central region of the cooling bar 1 and increases transversely to the transport direction 3, toward the edge regions of the cooling bar 1. For example, the distance d between nozzles increases parabolically from the central region to each edge region of the cooling bar 1. As a result, temperature differences in the rolled material 5 may be advantageously reduced when the temperature of the rolled material 5 decreases from a central region of the rolled material 5 to the edge regions of the rolled material 5. The distance d between nozzles varies, for example, between 25 mm and 70 mm.

Each optional coolant deflecting device 12 is arranged under an edge region of the spray chamber 7 and is provided for the purpose of collecting and conducting coolant which is output by full jet nozzles 11 arranged in the respective edge region of the spray chamber 7 (so-called edge masking). This prevents the coolant does not passing onto the corresponding edge region of the rolled material 5 and cooling the edge region of the rolled material 5 too strongly. For this purpose, each coolant deflecting device 12 comprises a coolant collecting container 12.1 and a coolant draining pipe 12.2. The coolant draining pipe 12.2 is arranged on a bottom side of the coolant collecting container 12.1 and conducts coolant collected in the coolant collecting container 12.1.

Each of FIGS. 4-7 shows a bottom view of the respective cooling bar 1 in a further exemplary embodiment of a cooling bar 1. The cooling bar 1 of each of the exemplary embodiments differs from the cooling bar 1 shown in FIGS. 1-3 simply by the distribution of the full jet nozzles 11 transversely to the transport direction 3. As in the cooling bar 1 shown in FIGS. 1-3, the full jet nozzles 11 are arranged in three nozzle rows 23-25 which extend transversely to the transport direction, the full jet nozzles 11 of different nozzle rows 23-25 are arranged offset to one another in the transport direction 3.

Figure 4:
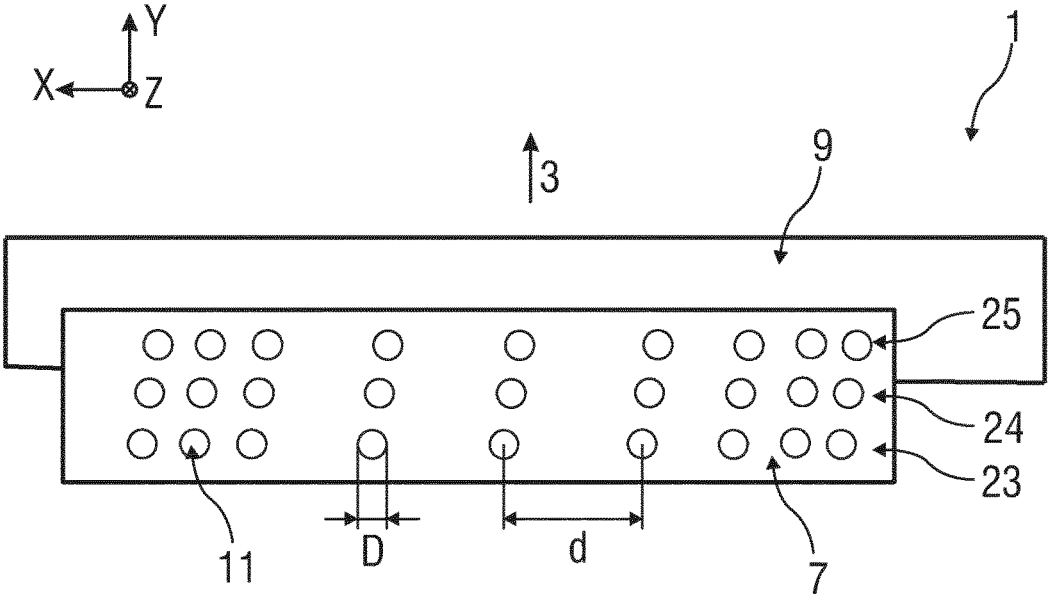
FIG. 4 shows a bottom view of a second exemplary embodiment of a cooling bar.

FIG. 4 shows a cooling bar 1 in which the distance d between nozzles of full jet nozzles 11 adjacent one another in each nozzle row 23-25 decreases from the central region of the cooling bar 1 transversely to the transport direction 3 toward the edge regions of the cooling bar 1 (for example parabolically). The nozzle density of the full jet nozzles 11 increases from the central region of the cooling bar 1 toward the edge regions of the cooling bar 1. As a result, temperature differences in the rolled material 5 may be advantageously reduced when the temperature of the rolled material 5 increases from a central region of the rolled material 5 to the edge regions of the rolled material 5.

Figure 5:
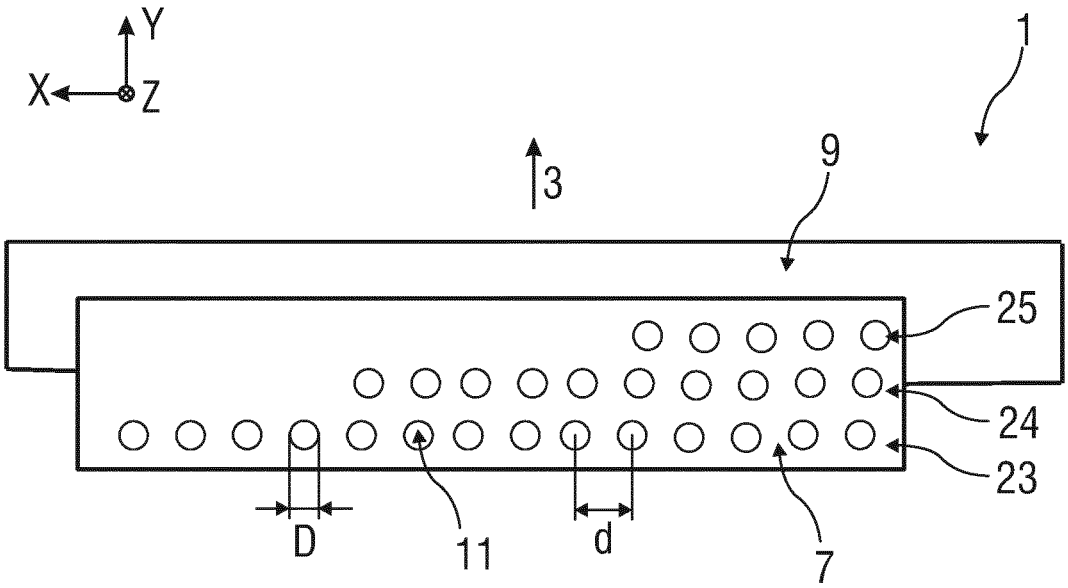
FIG. 5 shows a bottom view of a third exemplary embodiment of a cooling bar.

FIG. 5 shows a cooling bar 1 in which the distance d between nozzles of full jet nozzles 11 adjacent one another of all nozzle rows 23-25 is the same but the nozzle rows 23-25 extend to the left by different amounts from an edge region of the cooling bar 1 located on the right in FIG. 5 so that the nozzle density comprises a maximum nozzle density in the edge region located on the right. As a result, temperature differences in the rolled material 5 may be advantageously reduced when the temperature of the rolled material 5 decreases from the edge region of the rolled material 5 located on the right to the edge region of the rolled material 5 located on the left.

Figure 6:
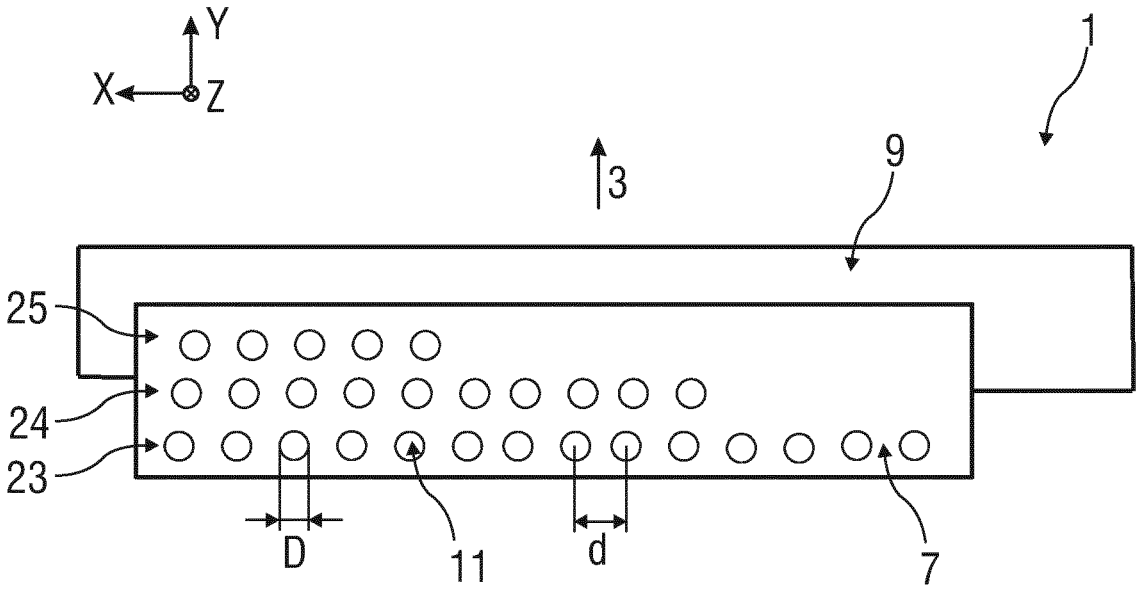
FIG. 6 shows a bottom view of a fourth exemplary embodiment of a cooling bar.

FIG. 6 shows a cooling bar 1 in which the distance d between nozzles of full jet nozzles 11 adjacent one another of all nozzle rows 23-25 is also the same but the nozzle rows 23-25 extend to the right by different amounts from an edge region of the cooling bar 1 located on the left in FIG. 6 so that the nozzle density comprises a maximum nozzle density in the edge region located on the left. As a result, temperature differences in the rolled material 5 may be advantageously reduced when the temperature of the rolled material 5 decreases from the edge region of the rolled material 5 located on the left to the edge region of the rolled material 5 located on the right.

Figure 7:
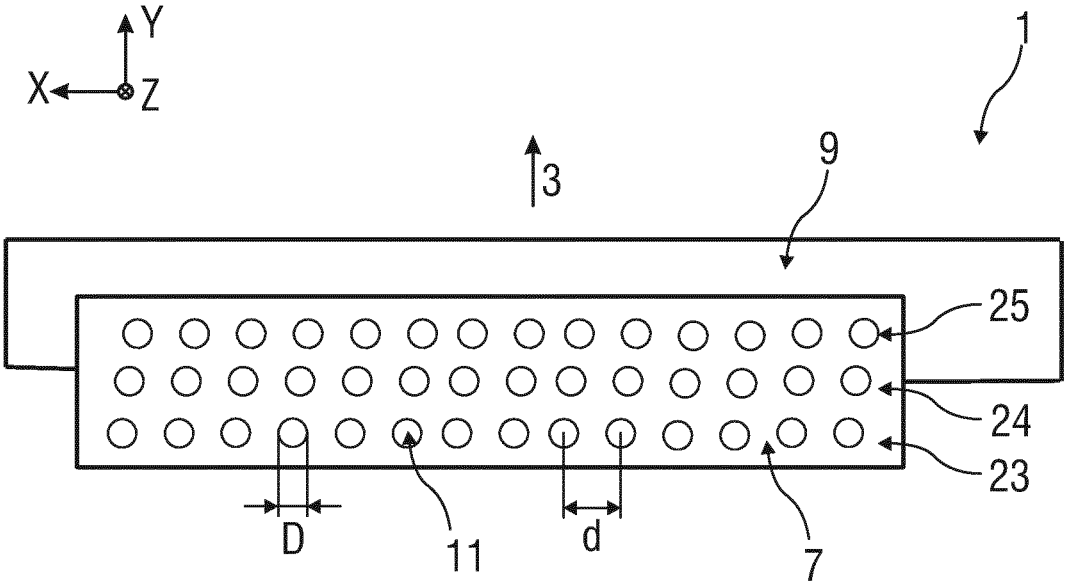
FIG. 7 shows a bottom view of a fifth exemplary embodiment of a cooling bar.

FIG. 7 shows a cooling bar 1 in which the distance d between nozzles of full jet nozzles 11 adjacent one another of all nozzle rows 23-25 is the same and also the nozzle density transversely to the transport direction 3 is constant. Such a cooling bar 1 consequently brings about uniform cooling of the rolled material 5 transversely to the transport direction 3.

Figure 8:
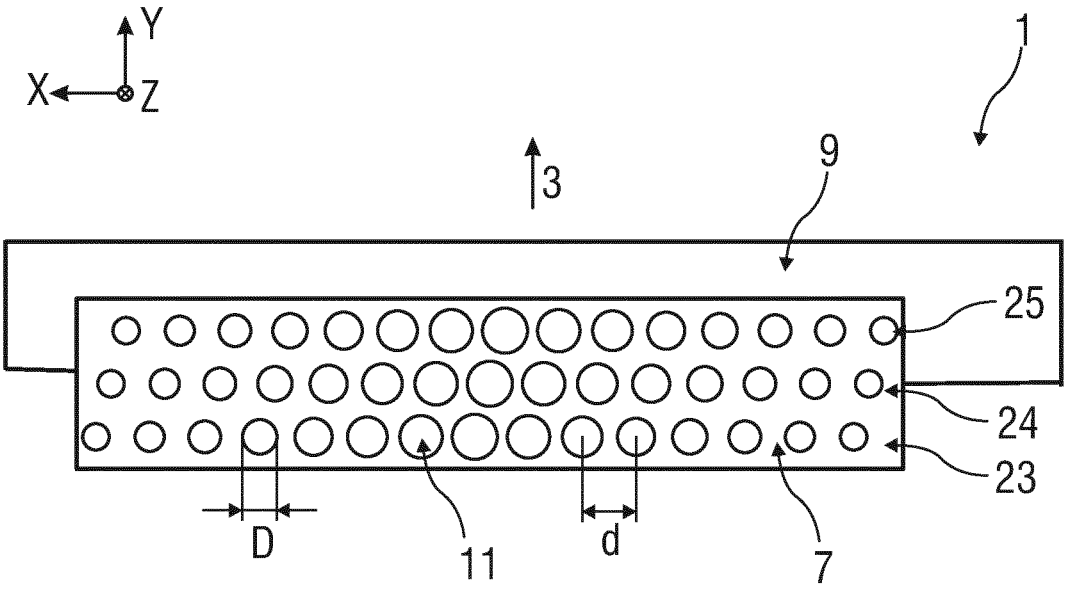
FIG. 8 shows a bottom view of a sixth exemplary embodiment of a cooling bar.

FIG. 8 shows a cooling bar 1 which differs from the cooling bar shown in FIG. 7 only as a result of the outlet diameter D of the full jet nozzles 11 varying transversely to the transport direction 3. In this case, the outlet diameter D is maximum in the central region of the cooling bar 1 and decreases toward the edge regions of the cooling bar 1 transversely to the transport direction 3. The decrease is able to be parabolic, for example.

The exemplary embodiments of cooling bars 1 shown in FIGS. 1-8 may be modified in various ways. For example, the distribution chamber 9 may be omitted in each case, so that the spray chamber 7 is filled directly with coolant instead of being filled via the distribution chamber 9. As an alternative, the full jet nozzles 11 may extend by a smaller distance or not at all into the spray chamber 7, i.e. the nozzle bodies 19 may be realized in a shorter manner or be completely omitted. In addition, the full jet nozzles 11 may be arranged in a number of nozzles rows 23-25 which deviates from three.

The exemplary embodiment shown in FIG. 8 may be modified additionally so that the outlet diameter D of the full jet nozzles 11 varies transversely to the transport direction 3 in a manner other than in the case of the cooling bar 1 shown in FIG. 8. For example, the outlet diameter D may be at a minimum in the central region of the cooling bar 1 and may increase transversely to the transport direction 3 toward the edge regions of the cooling bar 1, or the outlet diameter D may be at a maximum in an edge region of the cooling bar 1 and may decrease transversely to the transport direction 3 toward the edge region located opposite said edge region.

Figure 9:
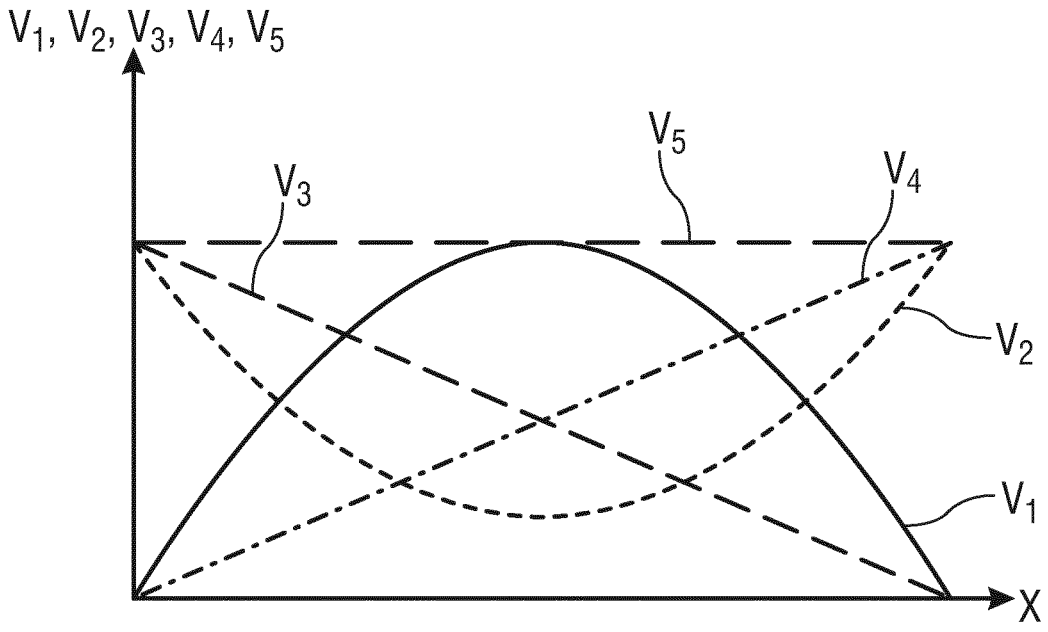
FIG. 9 shows volume flows of a coolant output by cooling bars shown in FIGS. 1 to 8 in dependence on a position.

FIG. 9 shows a schematic representation of volume flows $V_1$-$V_5$ of a coolant output by cooling bars shown in FIGS. 1-8 in dependence on a position transversely to the transport direction 3.

A first volume flow $V_1$ is generated by the cooling bar 1 shown in FIGS. 3-8 and decreases from a central region of the cooling bar 1 toward the edge regions, the decrease running, for example, parabolically.

A second volume flow $V_2$ is generated by the cooling bar 1 shown in FIG. 4 and increases from a central region of the cooling bar 1 toward the edge regions, the increase running, for example, parabolically.

A third volume flow $V_3$ is generated by the cooling bar 1 shown in FIG. 5 and decreases from a first edge region toward the second edge region of the cooling bar 1.

A fourth volume flow $V_4$ is generated by the cooling bar 1 shown in FIG. 6 and decreases from the second edge region toward the first edge region of the cooling bar 1.

A fifth volume flow $V_5$ is generated by the cooling bar 1 shown in FIG. 7 and is constant transversely to the transport direction 3.

Figure 10:
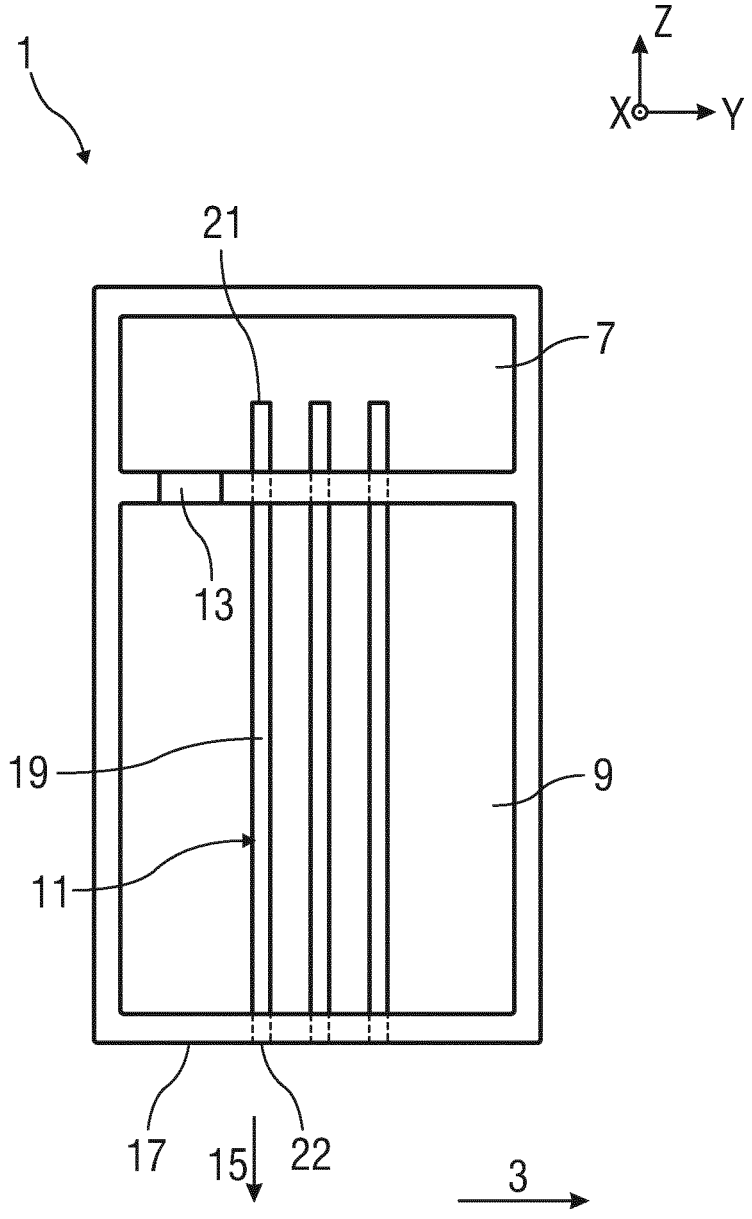
FIG. 10 shows a sectional representation of a seventh exemplary embodiment of a cooling bar.

FIG. 10 shows a sectional representation of a further exemplary embodiment of a cooling bar 1. The distribution chamber 9 is arranged below the spray chamber 7. Once again, the spray chamber 7 and the distribution chamber 9 are connected together by multiple through openings 13 and the cooling bar 1 comprises multiple full jet nozzles 11, each of which comprise a tubular nozzle body 19 with a vertically extending cylinder axis, i.e. parallel to the Z axis. In this exemplary embodiment, each of the nozzle bodies 19 extends from a bottom of the distribution chamber 9 through the distribution chamber 9 into the spray chamber 7 Each nozzle body comprises an open end 21, through which coolant from the spray chamber 7 may be fed into the full jet nozzle 11. The full jet nozzles 11, once again a nozzle density which varies transversely to the transport direction 3 and may be arranged distributed in an analogous manner to any of the exemplary embodiments shown in FIGS. 1-6.

Figure 11:
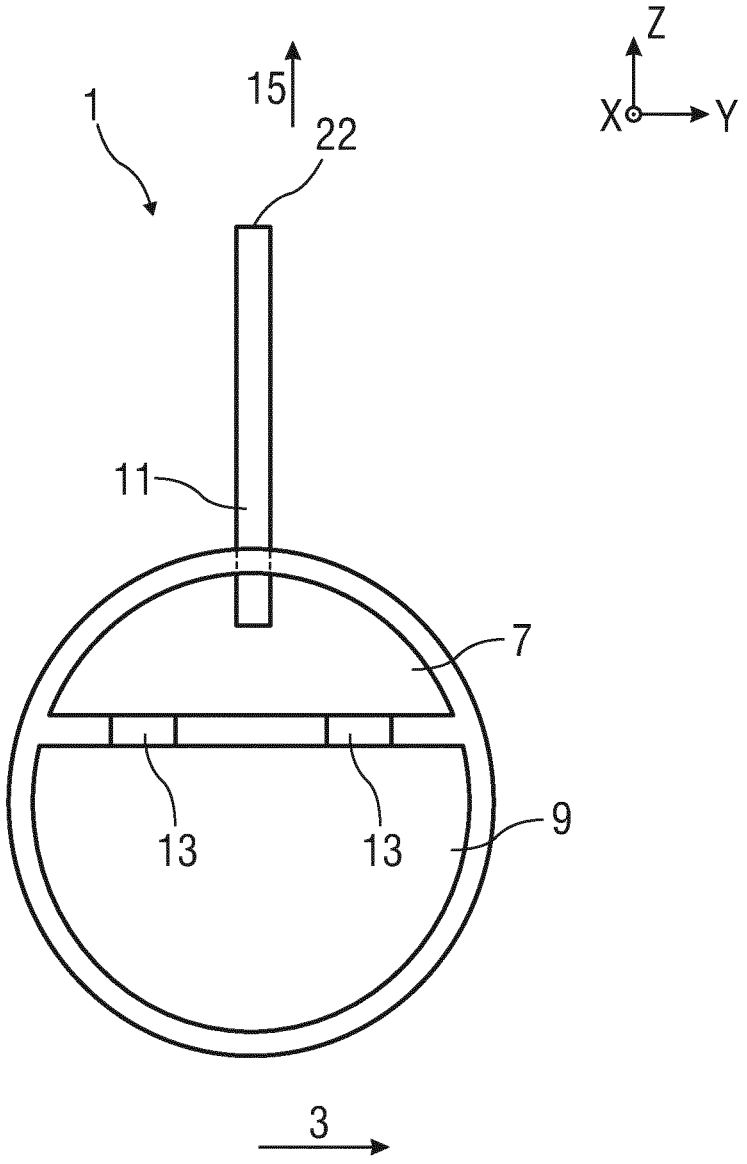
FIG. 11 shows a sectional representation of an eighth exemplary embodiment of a cooling bar and FIG. 12 shows a rolling line for hot rolling rolled material with a cooling device for cooling the rolled material.

FIG. 11 shows a sectional representation of a further exemplary embodiment of a cooling bar 1. The distribution chamber 9 is arranged below the spray chamber 7. Once again, the spray chamber 7 and the distribution chamber 9 are connected together by multiple through openings 13, and the cooling bar 1 comprises multiple full jet nozzles 11. The full jet nozzles 11 are guided out of the spray chamber 7 at an upper side of the chamber 7 and are directed straight upward so that they output coolant upward. A cooling bar 1 shown in FIG. 11 is consequently provided for being arranged below the rolled material 5 and for distributing coolant on a bottom side of the rolled material 5. The full jet nozzles 11 may, once again, comprise a nozzle density which varies transversely to the transport device 3.

FIG. 12 shows a schematic representation of a rolling line 27 for hot rolling rolled material 5 which is transported in a transport direction 3 through the rolling line 27. The rolling line 27 includes a finishing line 29 and a cooling section 31. Multiple roll stands 33 arranged one behind another in the finishing line 29 reshape the rolled material 5. Two roll stands 33 are shown as an example in FIG. 12. However, the finishing line 29 may also comprise a different number of roll stands 33. The cooling section 31 connects to the finishing line 29 and comprises a cooling device 35 for cooling the rolled material.

The cooling device 35 includes multiple cooling bars 1, a temperature measuring device 37 and a control device 39. Each cooling bar 1 comprises multiple full jet nozzles 11, through each of which outputs a coolant jet of a coolant with an almost constant jet diameter to the rolled material 5. Some cooling bars 1 are arranged one behind another in the feed direction of the material 5 above the rolled material 5. The bars output coolant jets spray downward onto the upper side of the rolled material 5. Other cooling bars 1 are arranged one behind another in the feed direction of the material 5 below the rolled material 5. The lower output coolant jets spray upward onto a bottom side of the rolled material 5. FIG. 12 shows an example of five cooling bars 1 arranged above the rolled material 5 and five cooling bars 1 arranged below the rolled material 5. However, the cooling device 35 may also comprise other numbers of cooling bars 1 arranged above and/or below the rolled material 5.

At least two of the cooling bars 1, and preferably, are in each case at least four of the cooling bars 1 are arranged above the rolled material 5 and at least four of the cooling bars 1 arranged below the rolled material 5, have nozzle densities and/or outlet diameters D of their full jet nozzles 11 which vary differently from one nozzle to another, transversely to the transport direction 3. The remaining cooling bars 1 have a constant nozzle density as the exemplary embodiment shown in FIG. 7.

The cooling bars 1 with varying nozzle densities and/or varying outlet diameters D are preferably arranged with reference to the transport direction upstream of the cooling bars 1 with constant nozzle densities. The achievement here is that at the start of the cooling section 31, where the temperature of the rolled material 5 is still very high, local temperature differences transversely to the transport direction 3 may be reduced by cooling bars 1 with nozzle densities which vary transversely to the transport direction 3, while following cooling bars 1 with constant nozzle densities only reduce the overall temperature of the rolled material 5 tempered uniformly transversely to the transport direction 3.

For example, each of the first four cooling bars 1 arranged above the rolled material 5 and the first four cooling bars 1 arranged below the rolled material 5 include a cooling bar 1 with a nozzle density which decreases from a central region of the cooling bar 1 to the edge regions of the cooling bar 1 analogously to FIG. 3. They also include a cooling bar 1 with a nozzle density which increases from a central region of the cooling bar 1 to the edge regions of the cooling bar 1 analogously to FIG. 4. They include a cooling bar 1 with a nozzle density which decreases from a first edge region (located on the right in FIG. 5) of the cooling bar 1 to the second edge region (located on the left in FIG. 5) of the cooling bar 1 analogously to FIG. 5. These include a cooling bar 1 with a nozzle density which increases from the first edge region of the cooling bar 1 to the second edge region of the cooling bar 1 analogously to FIG. 6.

In addition, each of the cooling bars 1 arranged above the rolled material 5 preferably comprises full jet nozzles 11 and/or a spray chamber 7 and a distribution chamber 9 as the cooling bars 1 shown in FIGS. 1 and 2 in order to reduce coolant running from the coolant bars 1 onto the rolled material 5 in the event of an interruption in coolant supply to the cooling bars 1. The coolant bars 1 arranged below the rolled material 5 may be realized in a simpler manner, i.e. those cooling bars 1 may comprise simply realized full jet nozzles 11 without elongated nozzle bodies 19 and/or may not be divided into a spray chamber 7 and a distribution chamber 9, as no coolant may run onto the rolled material 5 from the cooling bars 1 arranged below the rolled material 5 in the event of an interruption in the coolant supply to the cooling bars 1.

The temperature measuring device 37 is preferably arranged as shown in FIG. 12 upstream of the cooling bars 1 of the cooling device 35. In addition, a further temperature measuring device 37 may be arranged downstream of a cooling bar 1 of the cooling device 35. The temperature measuring device 37 is provided for the purpose of determining a temperature distribution of a temperature of the rolled material 5 transversely to the transport direction 3. For example, the temperature measuring device 37 may comprise an infrared scanner for recording the temperature with an accuracy of preferably ±2° C.

The control device 39 is provided for the purpose of controlling flow volumes of coolant to the individual cooling bars 1 in dependence on the temperature distribution of the temperature of the rolled material 5 transversely to the transport direction 3 determined with the temperature measuring device 37. The control device 39 includes a control unit 47, two coolant pumps 49 and a control valve 51 for each cooling bar 1.

The flow volume of coolant to one of the cooling bars 1 is adjustable by each control valve 51. The control valves 51 of the cooling bars 1 arranged above the rolled material 5 are connected to one of the two coolant pumps 49. The control valves 51 of the cooling bars 1 arranged below the rolled material 5 are connected to the other coolant pump 49. Instead of two coolant pumps 49, it is also possible to provide a different number of coolant pumps 49, for example only one coolant pump 49, which is connected to all control valves 51, or to provide more than two coolant pumps 49, which are each connected to only one control valve 51 or to a subset of control valves 51. Instead of the coolant pumps 49, it is alternatively or additionally possible to provide an overhead tank filled with coolant which is arranged at a suitable height above the control valves 51 and from which the control valves 51 are supplied with coolant. In cases in which a supply pressure of a coolant supply system, for example a water supply system, is already sufficient, it is even possible to dispense entirely with coolant pumps 49 or an overhead container. As each cooling bar 1 comprises full jet nozzles 11, it may be sufficient to supply the cooling bars 1 at a coolant pressure of approximately 4 bar. A typical flow volume of coolant of a cooling bar 1 is approximately 175 $m^3/h$.

Measured signals detected by the temperature measuring device 37 are supplied to the control unit 47. The coolant pumps 49 and control valves 51 are controllable by the control unit 47. Flow volumes of coolant to the individual cooling bars 1, in particular to those with varying nozzles densities, are calculated by the control unit 47 in dependence on the temperature distribution detected with the temperature measuring device 37 and are adjusted by controlling the control valves 51 in order to level out temperature differences in the temperature of the rolled material 5 transversely to the transport direction 3 by the use of and by a suitable combination of cooling bars 1 with varying nozzle densities and to reduce the temperature of the rolled material overall to a desired value, for example a coiling temperature. The flow volumes of coolant to the individual cooling bars 1, in this case, are calculated by the control unit 47, for example by a model produced from parameters of the rolled material 5 such as the thickness, temperature and/or thermal capacity thereof.

Although the detail of the invention has been illustrated and described in more depth by preferred exemplary embodiments, the invention is not restricted by the disclosed examples and other variations can be derived therefrom by the expert without departing from the scope of protection of the invention.

LIST OF REFERENCES

1 Cooling bar
3 Transport direction
5 Rolled material
7 Spray chamber
9 Distribution chamber
11 Full jet nozzle
12 Coolant deflecting device
12.1 Coolant collecting container
12.2 Coolant draining pipe
13 Through opening
15 Output direction
17 Output side
19 Nozzle body
21 Open end
22 Outlet opening
23 to 25 Nozzle row
27 Rolling line
29 Finishing line
31 Cooling section
33 Roll stand
35 Cooling device
37 Temperature measuring device
39 Control device
47 Control unit
49 Coolant pump
51 Control valve
d Distance between nozzles
D Outlet diameter
X, Y, Z Cartesian coordinates
$V_1$ to $V_5$ Volume flow

The invention claimed is:

1. A cooling bar for cooling rolled material which is moved in a transport direction, the cooling bar including:

a spray chamber which is fillable with a coolant;

a distribution chamber for intermediate storage of the coolant and which is connected to the spray chamber by at least one through opening for filling the spray chamber with coolant from the distribution chamber;

each through opening is arranged on an upper side of the distribution chamber and extends between the distribution chamber and the spray chamber;

multiple full jet nozzles which are suppliable with coolant from the spray chamber, each jet nozzle is configured to supply and output a coolant jet of a coolant to the rolled material in an output direction, and is configured so that the coolant jet has a substantially constant jet diameter;

each full jet nozzle comprises a tubular nozzle body which includes an open end arranged in an upper region of the cooling bar inside the spray chamber, the open end configured to receive coolant into the full jet nozzle, the tubular nozzle body extending fully inside the spray chamber from the bottom to an upper region above the upper side of the distribution chamber;

wherein the open end is arranged above a height of the upper side of the distribution chamber, wherein the full jet nozzles are positioned in a plurality of nozzle rows extending transversely to the transport direction; and wherein the full jet nozzles of various nozzle rows of the plurality of nozzle rows are positioned to be offset to one another in the transport direction.

2. The cooling bar as claimed in claim 1, wherein a nozzle density of the multiple full jet nozzles of the cooling bar and the nozzle density vary transversely to the transport direction.

3. The cooling bar as claimed in claim 1, wherein an outlet diameter of the full jet nozzles varies transversely to the transport direction.

4. The cooling bar as claimed in claim 1, wherein a distance between the nozzles of the full jet nozzles adjacent one another in each of the nozzle rows varies.

5. The cooling bar as claimed in claim 1, further comprising:

at least one coolant deflecting device configured for conducting coolant which is output by the full jet nozzles which are arranged at an edge region of the spray chamber.

* * * * *